US011512579B2

(12) United States Patent
LaValley et al.

(10) Patent No.: US 11,512,579 B2
(45) Date of Patent: Nov. 29, 2022

(54) HORIZONTAL DIRECTIONAL DRILLING RIG WITH HEALTH MONITORING OF COMPONENTS

(71) Applicant: LaValley Industries, LLC, Bemidji, MN (US)

(72) Inventors: Jason LaValley, Bemidji, MN (US); Jesse J. Kilde, Bemidji, MN (US); Daniel L. Larson, Bemidji, MN (US); Bill Brandt, Bemidji, MN (US)

(73) Assignee: LAVALLEY INDUSTRIES, LLC, Bemidji, MN (US)

( * ) Notice: Subject to any disclaimer, the term of this patent is extended or adjusted under 35 U.S.C. 154(b) by 749 days.

(21) Appl. No.: 15/605,324

(22) Filed: May 25, 2017

(65) Prior Publication Data

US 2017/0342816 A1 Nov. 30, 2017

Related U.S. Application Data

(60) Provisional application No. 62/341,192, filed on May 25, 2016.

(51) Int. Cl.
*E21B 7/02* (2006.01)
*E21B 3/02* (2006.01)
(Continued)

(52) U.S. Cl.
CPC ..... *E21B 47/00* (2013.01); *E21B 3/02* (2013.01); *E21B 7/022* (2013.01); *E21B 7/046* (2013.01); *E21B 19/083* (2013.01)

(58) Field of Classification Search
CPC ..... E21B 7/02; E21B 7/04
See application file for complete search history.

(56) References Cited

U.S. PATENT DOCUMENTS 6,554,082 B2 4/2003 Bischel et al.
6,845,825 B2 1/2005 Bischel et al.
(Continued)

FOREIGN PATENT DOCUMENTS

JP 5559936 7/2014
WO 2015192003 12/2015

OTHER PUBLICATIONS

International Search Report and Written Opinion of International Application No. PCT/US2017/034480, dated Aug. 25, 2017, 15 pages provided.

(Continued)

*Primary Examiner* — Robert E Fuller
*Assistant Examiner* — Theodore N Yao
(74) *Attorney, Agent, or Firm* — Hamre, Schumann, Mueller & Larson, P.C.

(57) ABSTRACT

A horizontal directional drilling rig is described. The rig can be entirely electrically powered. The performance (or "health") and/or the life cycle of individual components of the rig can be electronically monitored. This permits identification of specific individual components that are performing in a substandard manner or are not performing properly or have reached the end of their life cycle. Individual improperly performing components or components at the end of their life cycle can thus be specifically identified. The improperly performing component(s) or components at the end of their life cycle can then be replaced. In some embodiments, when a component is identified as performing improperly, the operation of other, properly functioning components of the rig can be modified accordingly to account for the improperly performing component.

18 Claims, 14 Drawing Sheets

(51) Int. Cl.

| | |
|---|---|
| ***E21B 7/04*** | (2006.01) |
| ***E21B 47/00*** | (2012.01) |
| ***E21B 19/083*** | (2006.01) |

(56) References Cited

U.S. PATENT DOCUMENTS

| | | | | |
|---|---|---|---|---|
| 7,413,031 | B2 | 8/2008 | Koch et al. | |
| 7,461,707 | B2 | 12/2008 | Gard | |
| 7,880,336 | B2 | 2/2011 | Gard | |
| 8,890,361 | B2 | 11/2014 | Gard | |
| 2003/0070841 | A1* | 4/2003 | Merecka | E21B 7/04 175/19 |
| 2004/0262043 | A1* | 12/2004 | Schuaf | E21B 3/02 175/57 |
| 2006/0081399 | A1* | 4/2006 | Jones | E21B 7/04 175/61 |
| 2006/0243490 | A1* | 11/2006 | Riel | E21B 7/04 175/62 |
| 2007/0175662 | A1 | 8/2007 | Kracik | |
| 2007/0246261 | A1* | 10/2007 | Lowe | E21B 44/02 175/122 |
| 2009/0105059 | A1 | 4/2009 | Dorry et al. | |
| 2009/0205868 | A1 | 8/2009 | Lane | |
| 2010/0133009 | A1 | 6/2010 | Carlson et al. | |
| 2012/0103633 | A1 | 5/2012 | Korach et al. | |
| 2013/0056271 | A1* | 3/2013 | Osara | B60K 6/00 175/17 |
| 2013/0068490 | A1 | 3/2013 | Van Zee et al. | |
| 2013/0214928 | A1* | 8/2013 | Kuittinen | E21B 7/025 340/669 |
| 2013/0327543 | A1 | 12/2013 | Reddy et al. | |
| 2014/0131113 | A1 | 5/2014 | Ebersole et al. | |
| 2015/0053483 | A1 | 2/2015 | Mebane, III | |
| 2015/0068808 | A1 | 3/2015 | Gard | |
| 2015/0160101 | A1* | 6/2015 | Gao | G01M 13/028 702/6 |
| 2015/0226013 | A1* | 8/2015 | Kirkhope | G01N 3/56 702/6 |
| 2015/0308191 | A1* | 10/2015 | Zhan | E21B 12/02 703/2 |
| 2017/0114630 | A1* | 4/2017 | Erdos | E21B 47/01 |
| 2018/0181830 | A1* | 6/2018 | Luharuka | E21B 43/26 |

OTHER PUBLICATIONS

Berco Horizontal Directional Drilling Equipment Parts And Maintenance Manual, Berco 500 RIG 5 Bmel B002, Baker Marine Technical Services PTE Ltd, No. 6 Pioneer Sector One Singapore 2262, published prior to May 25, 2016.

"Meet the New Standard in HDD RIGS", obtained from www.normag.com on or about Feb. 15, 2017; 4 pages.

Supplementary European Search Report issued in corresponding European Application No. 17803585.3, dated May 27, 2019, 8 pages.

Extended European search report issued in European Application No. 20211763.6., dated Mar. 15, 2021; 8 pages.

* cited by examiner

HORIZONTAL DIRECTIONAL DRILLING RIG WITH HEALTH MONITORING OF COMPONENTS

FIELD

The technology described herein relates to horizontal directional drilling, horizontal directional drilling rigs, and methods of controlling the operation and performance of horizontal directional drilling rigs. In one embodiment the horizontal directional drilling rigs can be entirely electrically powered. However, the technology described herein is not limited to electrically powered horizontal directional drilling rigs, and unless otherwise indicated many of the innovations described herein can be applied to hydraulically powered horizontal directional drilling rigs or to horizontal directional drilling rigs powered by a combination of electric and hydraulic power.

BACKGROUND

Many examples of horizontal directional drilling rigs are known. For example, horizontal directional drilling rigs are described in U.S. Pat. Nos. 6,554,082, 6,845,825, 7,413,031, 7,461,707, 7,880,336, 8,890,361, and U.S. Patent Application Publication 2015/0068808. Another example is the NM 300-140TE HDD Rig available from Normag of Terband-Heerenveen, The Netherlands.

SUMMARY

Methods and systems relating to horizontal directional drilling (HDD) rigs are described. The HDD rigs can be entirely electrically powered. However, in other embodiments, the methods and systems described herein can be utilized, individually or in any combination, on hydraulically powered HDD rigs or on HDD rigs powered by a combination of electric power and hydraulic power.

In one embodiment, the operation or "health" of individual components of an HDD rig (whether electrically powered, hydraulically powered or both) can be electronically monitored. This permits identification of specific individual components that are performing in a substandard manner or are not performing properly. Individual improperly performing components can thus be specifically identified. The improperly performing component(s) can then be replaced. In some embodiments, when a component is identified as performing improperly, the operation of other, properly functioning similar components of the HDD rig can be modified accordingly to account for the improperly performing component.

Monitoring performance also includes monitoring cycles of components. This permits tracking of the total cycles of the components. So instead of waiting for a component to fail or to begin to fail, a component can be replaced at the end of a predetermined number of cycles.

In one embodiment, a horizontal directional drilling rig operation method is provided where the horizontal directional drilling rig includes a plurality of traverse carrier drive components disposed on a traverse carrier and a plurality of drill pipe rotation components disposed on the traverse carrier. The method includes electronically monitoring the performance of one or more of the following: a plurality of the traverse carrier drive components; a plurality of the drill pipe rotation components; a plurality of power control components that supply power to the traverse carrier drive components and the drill pipe rotation components. Based on the electronic monitoring, a specific one of the plurality of traverse carrier drive components, a specific one of the drill pipe rotation components, or a specific one of the power control components are identified as having substandard performance or being at the end of their life cycle. The performance of at least one of the other traverse carrier drive components can be adjusted if one of the plurality of traverse carrier drive components is identified as having substandard performance, or the performance of at least one of the other drill pipe rotation components can be adjusted if one of the plurality of drill pipe rotation components is identified as having substandard performance, or the performance of at least one of the other power control components can be adjusted if one of the plurality of power control components is identified as having substandard performance. In addition, the specific traverse carrier drive component identified as having substandard performance or at the end of its life cycle can be replaced, or the specific drill pipe rotation component identified as having substandard performance or at the end of its life cycle can be replaced, or the specific power control component identified as having substandard performance or at the end of its life cycle can be replaced.

In another embodiment, a horizontal directional drilling rig system includes a horizontal directional drilling rig that includes a support frame, a traverse carrier movably disposed on the support frame for forward and reverse movement on the support frame, a plurality of traverse carrier drive components disposed on the traverse carrier, and a plurality of drill pipe rotation components disposed on the traverse carrier. A plurality of power control components supply power to the traverse carrier drive components and the drill pipe rotation components. In addition, a health monitoring system electronically monitors the performance or cycles of one or more of: the traverse carrier drive components, the drill pipe rotation components, and the power control components. The health monitoring system can identify a specific one of the plurality of traverse carrier drive components, a specific one of the drill pipe rotation components, or a specific one of the power control components as having substandard performance or as being at the end of its life cycle. Based on such identification, the performance of at least one of the other traverse carrier drive components can be adjusted if one of the plurality of traverse carrier drive components is identified as having substandard performance or at the end of its life cycle, or the performance of at least one of the other drill pipe rotation components can be adjusted if one of the plurality of drill pipe rotation components is identified as having substandard performance or at the end of its life cycle, or the performance of at least one of the other power control components can be adjusted if one of the plurality of power control components is identified as having substandard performance or at the end of its life cycle.

In another embodiment, the HDD rig includes a plurality of electrically powered traverse carrier drive motors disposed on a traverse carrier and a plurality of electrically powered drill pipe rotation motors disposed on the traverse carrier. An HDD rig operation method includes electronically monitoring the performance of a plurality of variable frequency drives that are electrically connected to and supply electrical power to the electrically powered traverse carrier drive motors and to the electrically powered drill pipe rotation motors. Based on the electronic monitoring, a specific one of the variable frequency drives can be identified as having substandard performance. The variable frequency drive identified as having substandard performance can then be replaced.

In another embodiment, an HDD rig includes a plurality of traverse carrier drive components disposed on a traverse carrier and a plurality of drill pipe rotation components disposed on the traverse carrier. An HDD rig operation method includes electronically monitoring the performance of a plurality of the traverse carrier drive components and/or the performance of a plurality of the drill pipe rotation components. Based on the electronic monitoring, a specific one of the plurality of traverse carrier drive components and/or a specific one of the drill pipe rotation components can be identified as having substandard performance. The performance of at least one of the other traverse carrier drive components can be adjusted if one of the plurality of traverse carrier drive components is identified as having substandard performance, or the performance of at least one of the other drill pipe rotation components can be adjusted if one of the plurality of drill pipe rotation components is identified as having substandard performance. Alternatively, the specific traverse carrier drive component identified as having substandard performance or the specific drill pipe rotation component identified as having substandard performance can be replaced.

In another embodiment, an HDD rig system can include an HDD rig that includes a support frame, a traverse carrier movably disposed on the support frame for forward and reverse movement on the support frame, a plurality of electrically powered traverse carrier drive motors disposed on the traverse carrier, and a plurality of electrically powered drill pipe rotation motors disposed on the traverse carrier. Each of the electrically powered traverse carrier drive motors and the electrically powered drill pipe rotation motors can have at least one variable frequency drive electrically connected thereto, where each variable frequency drive supplies electrical power to the respective electrically powered traverse carrier drive motor and to the electrically powered drill pipe rotation motor.

DRAWINGS

DETAILED DESCRIPTION

Figure 1:
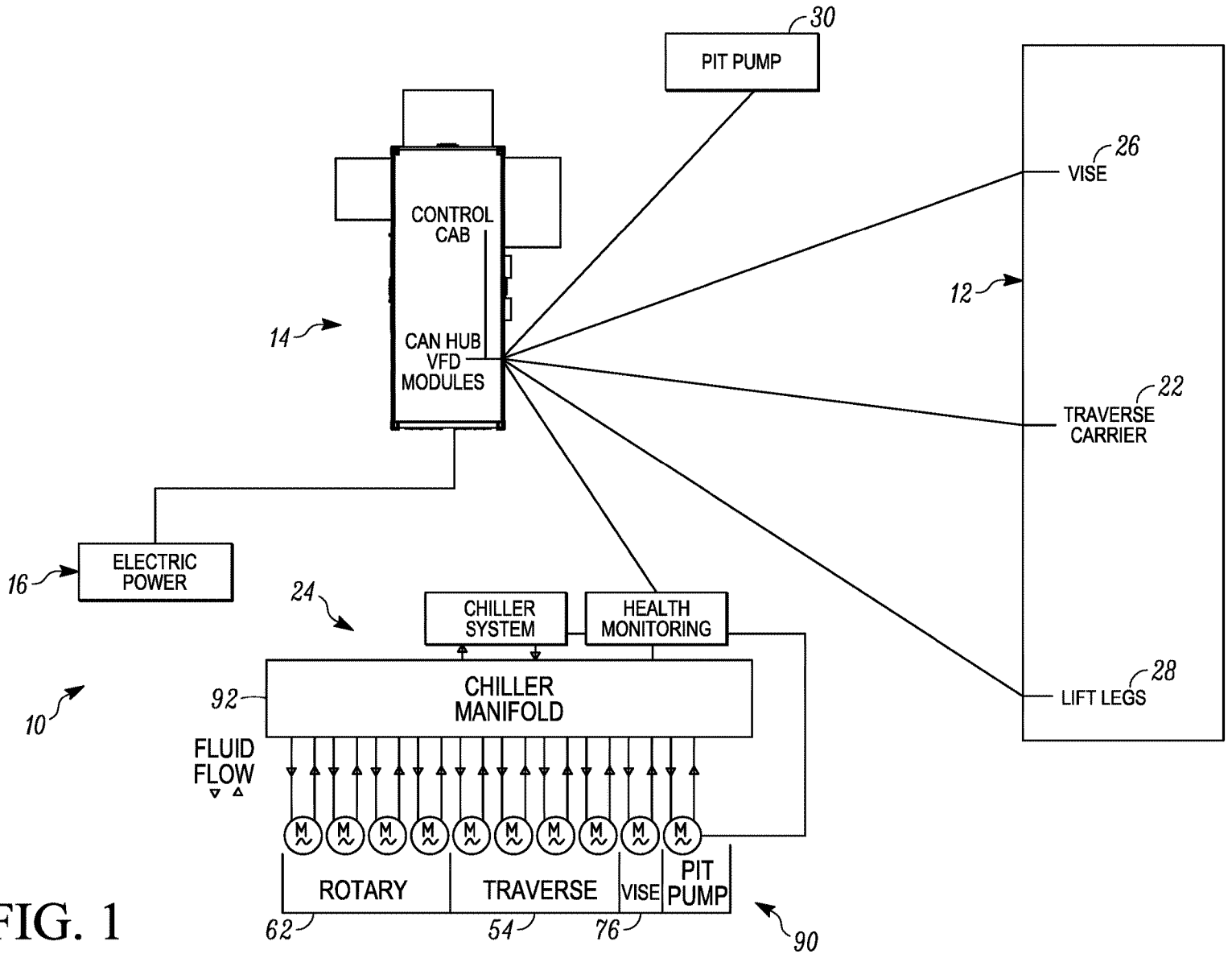
FIG. 1 is a schematic view of one embodiment of an HDD rig system described herein.
Figure 2:
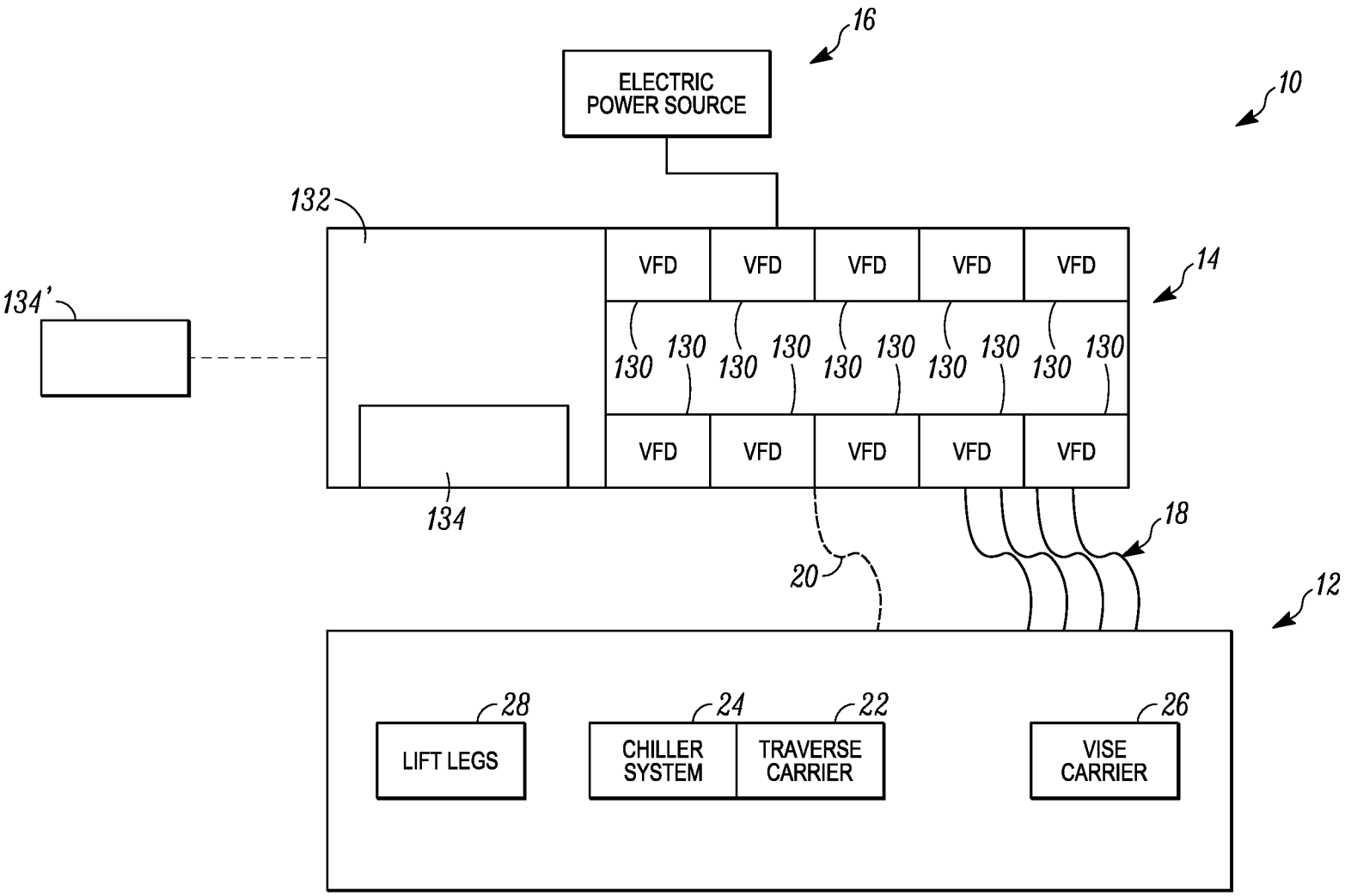
FIG. 2 is another schematic view of an HDD rig system described herein.

Referring to FIGS. 1 and 2, an HDD rig system 10 is illustrated. The HDD rig system 10 is configured to perform horizontal directional drilling. Horizontal directional drilling is well known to those of ordinary skill in the art.

The system 10 includes an HDD rig 12 that performs the actual horizontal directional drilling, a control cab 14 that controls operation of the HDD rig 12 and other components of the system 10, and an electric power source 16 that supplies electrical power. The various components on the HDD rig 12 are described herein as being electrically powered indirectly via the electric power source 16. Accordingly, the HDD rig 12 can be described as being an electric HDD rig 12, an electrically powered HDD rig 12, or the like. The control cab 14 contains controls that control the operation of the HDD rig 12, as well as power control components that condition the electricity from the electrical power source 16 making the electricity suitable for use by the various components of the HDD rig 12. Referring to FIG. 2, electricity can be directed from the control cab 14 to the HDD rig 12 via a plurality of separate electrical lines 18 or via a single, bundled electrical line 20 (illustrated by a broken line). However, many of the features described herein, such as health monitoring of components, removal of the traverse carrier and vise carrier from the ends of the HDD rig, movement of the wheel assembly, and other features described herein can be applied to and used on hydraulically powered or combined electric and hydraulically powered HDD rigs as well. The power control components can be adjustable speed drives such as variable frequency drives in the case of an electrically powered HDD rig as discussed further below. Alternatively, in the case of a hydraulically powered HDD rig, the power control components can be pumps, drive motors and controllers to control the pressure and volume of the hydraulic fluid.

As shown in FIGS. 1 and 2, the HDD rig 12 includes a traverse carrier 22 that is actuatable in forward and reverse directions to drive and retract drill pipe during horizontal directional drilling. A chiller system 24 is mounted on and travels with the traverse carrier 22 for cooling the various electric drive motors on the traverse carrier 22 (as described further below). A vise carrier 26 is located forward of the traverse carrier 22 and includes a make/break vise mechanism (described further below) that can connect and disconnect drill pipe during horizontal directional drilling. In addition, lift legs 28 (discussed further below) are provided that are actuatable to raise and lower an end of the HDD rig 12 to change the angle of the HDD rig 12.

Figure 3:
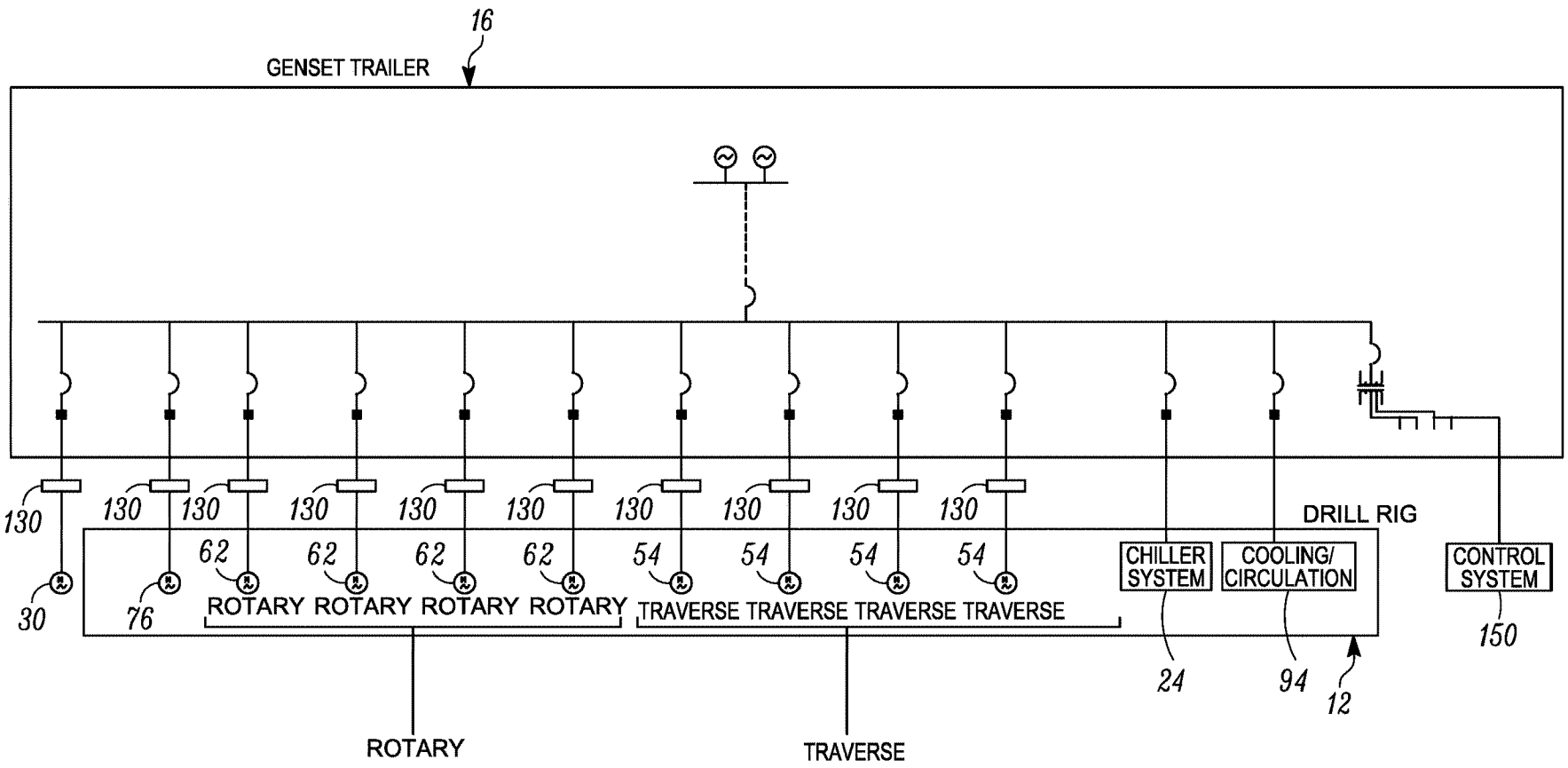
FIG. 3 depicts an electrical schematic where an electrical power source in the form of at least one generator provides electrical power to the HDD rig system.

The traverse carrier 22, the chiller system 24, the vise carrier 26 and the lift legs 28 include various components that are electrically powered using electric power from the electric power source 16 via the control cab 14. As shown in FIG. 1, the system 10 can include other elements as well, such as a pit pump 30 which pumps mud from the pit where the drilling takes place. The pit pump 30 can also be electrically powered with electric power from the electric power source 16 via the control cab 14. The electric power source 16 can be any source(s) of electric power. For example, as shown in FIG. 3, the electric power source 16 can be one or more electric generators. In another embodiment shown in FIG. 4, the electric power source 16 can be line power obtained from an available electrical power line.

Referring to FIGS. 5-8, an example mechanical construction of the HDD rig 12 will now be described. The HDD rig 12 includes a support frame 40 that has a first or front end 42 and a second or back end 44. A toothed rack 46 is disposed on an upper side of the support frame 40 on which the traverse carrier 22 and the vise carrier 26 are movably disposed, with the vise carrier 26 adjacent to the end 42. The toothed rack 46 can extend any distance along the support frame 40 to permit the desired movements of the traverse carrier 22 and optionally the vise carrier 26. In the illustrated example, the toothed rack 46 extends the entire distance of the support frame 40 from the end 42 to the end 44. A wheel assembly 48 is connected to a lower side of the support frame 40 which rollingly supports the support frame 40 for rolling movement along the ground when transporting the HDD rig 12. The lift legs 28 are disposed on the support frame 40 adjacent to the end 44 thereof. The chiller system 24 is shown on the traverse carrier 22 so that the chiller system 24 moves with the traverse carrier 22 as the traverse carrier 22 moves along the support frame 40. With the construction described herein, the various components 22, 24, 26, 28 could be arranged as shown in FIGS. 5-8 or could be reversed so that the vise carrier 26 is adjacent to the end 44, the lift legs 28 disposed adjacent to the end 42 and the wheel assembly disposed near the end 44. Therefore, the HDD rig 12 can be reversible with either the end 42 or the end 44 being the first or front end, and either the end 42 or the end 44 being the second or back end.

Still referring to FIGS. 5-8, the traverse carrier 22 comprises a platform 50 disposed on the toothed rack 46. A plurality of traverse carrier drive components 52 are disposed on the platform 50 and are in driving engagement with the toothed rack 46 via gears such as pinion gears driven by the drive components 52 for moving the platform 50 in forward (i.e. toward the end 42) and reverse (i.e. toward the end 44) directions. During a forward movement, the traverse carrier 22 is driving the drill string in a forward direction to advance the drill string, while in a reverse movement the traverse carrier 22 is pulling the drill string from the drilled hole or is reversing to permit attachment of a new segment of drill pipe.

In the example illustrated in FIGS. 5-8, the traverse carrier 22 includes four of the traverse carrier drive components 52. However, a smaller or larger number of traverse carrier drive components 52 can be used. Each traverse carrier drive component 52 includes a reversible, electrically powered traverse carrier drive motor 54 and a gearbox 56 engaged with an output shaft of the drive motor 54. The drive motors 54 drive the gearboxes 56, which in turn drive gears (not shown) that are in driving engagement with the toothed rack 46 to cause the platform 50 to move in forward or reverse directions on the support frame 40 depending upon the direction of output rotation of the drive motors 54. The drive motors 54 can be any electrically powered reversible motors. In one non-limiting embodiment, the drive motors 54 can be GVM Series Motors available from Parker Hannifin Corporation of Cleveland, Ohio. In another embodiment, the drive components 52 could be what can be referred to as e-pump technology (or electric motor driven pumps) an example of which is the Hydrapulse™ electric motor driven pumps available from Terzo Power Systems of El Dorado Hills, Calif., which would eliminate the need for the gearboxes 56.

In one specific embodiment, the drive motors 54 are configured to be cooled by a refrigerant liquid that is circulated therethrough by the chiller system 24 for cooling the drive motors 54. An example of a liquid cooled drive motor that can be used is the GVM Series Motors available from Parker Hannifin Corporation of Cleveland, Ohio.

In the illustrated example in FIGS. 5-8, the drive motors 54 are oriented so that the output shafts thereof are arranged substantially vertically or perpendicular to the plane of the platform 50. The gearboxes 56 are arranged between the drive motors 54 and the platform 50. However, other orientations of the drive motors 54 and the gearboxes 56 are possible as long as the drive motors 54 can drive the traverse carrier 22.

Still referring to FIGS. 5-8, a plurality of drill pipe rotation components 60 are also disposed on the platform 50. The drill pipe rotation components 60 drive the drill pipe in a clockwise or counterclockwise direction during drilling, when connecting a new segment of drill pipe, and when removing a segment of drill pipe. In the example illustrated in FIGS. 5-8, the traverse carrier 22 includes four of the drill pipe rotation components 60 that are arranged circumferentially about a rotation axis of the drill pipe. However, a smaller or larger number of drill pipe rotation components 60 can be used.

Each drill pipe rotation component 60 includes a reversible, electrically powered drill pipe rotation motor 62 and a gearbox 64 engaged with an output shaft of the rotation motor 62. The rotation motors 62 drive the gearboxes 64, which in turn are in driving engagement with the drill pipe in a known manner to cause the drill pipe to rotate in the desired depending upon the direction of output rotation of the rotation motors 62. The rotation motors 62 can be any electrically powered reversible motors. In one non-limiting embodiment, the rotation motors 62 can be GVM Series Motors available from Parker Hannifin Corporation of Cleveland, Ohio. In another embodiment, the drill pipe rotation components 60 could be e-pump technology (or electric motor driven pumps) an example of which is the Hydrapulse™ electric motor driven pumps available from Terzo Power Systems of El Dorado Hills, Calif., which would eliminate the need for the gearboxes 64.

In one specific embodiment, the rotation motors 62 can also be configured to be cooled by the refrigerant liquid that is circulated therethrough by the chiller system 24 for cooling the rotation motors 62. An example of a liquid cooled rotation motor that can be used is the GVM Series Motors available from Parker Hannifin Corporation of Cleveland, Ohio.

In the illustrated example in FIGS. 5-8, the rotation motors 62 are oriented so that the output shafts thereof are arranged substantially horizontally or parallel to the plane of the platform 50 or parallel to the drill pipe. The gearboxes 64 are arranged at the output of the rotation motors 62. However, other orientations of the rotation motors 62 and the gearboxes 64 are possible as long as the rotation motors 62 can rotate the drill pipe.

The vise carrier 26 also comprises a platform 70 that is movably disposed on the toothed rack 46. A plurality of vise carrier drive components 72 are disposed on the platform 70 and are in driving engagement with the toothed rack 46 for moving the platform 70 in forward (i.e. toward the end 42) and reverse (i.e. toward the end 44) directions to correctly position a make/break vise mechanism 74 disposed on the platform 70.

Referring to FIGS. 5-8 and 13, in the illustrated example the vise carrier 26 includes two of the vise carrier drive components 72. However, a smaller or larger number of vise carrier drive components 72 can be used. Each vise carrier drive component 72 includes a reversible, electrically powered vise carrier drive motor 76 and a gearbox 78 engaged with an output shaft of the drive motor 76. The drive motors 76 drive the gearboxes 78, which in turn are in driving engagement with the toothed rack 46 to cause the platform 70 to move in forward or reverse directions on the support frame 40 depending upon the direction of output rotation of the drive motors 76. The drive motors 76 can be any electrically powered reversible motors. In one non-limiting embodiment, the drive motors 76 can be GVM Series Motors available from Parker Hannifin Corporation of Cleveland, Ohio. In another embodiment, the vise carrier drive components 72 could be e-pump technology (or electric motor driven pumps) an example of which is the Hydrapulse™ electric motor driven pumps available from Terzo Power Systems of El Dorado Hills, Calif., which would eliminate the need for the gearboxes 78.

In one specific embodiment, the drive motors 76 are configured to be cooled by the refrigerant liquid that is circulated therethrough by the chiller system 24 for cooling the drive motors 76. An example of a liquid cooled drive motor that can be used is the GVM Series Motors available from Parker Hannifin Corporation of Cleveland, Ohio.

In the illustrated example in FIGS. 5-8, the drive motors 76 are oriented so that the output shafts thereof are arranged substantially vertically or perpendicular to the plane of the platform 70. The gearboxes 78 are arranged between the drive motors 76 and the platform 70. However, other orientations of the drive motors 76 and the gearboxes 78 are possible as long as the drive motors 76 can drive the vise carrier 26.

Figure 13:
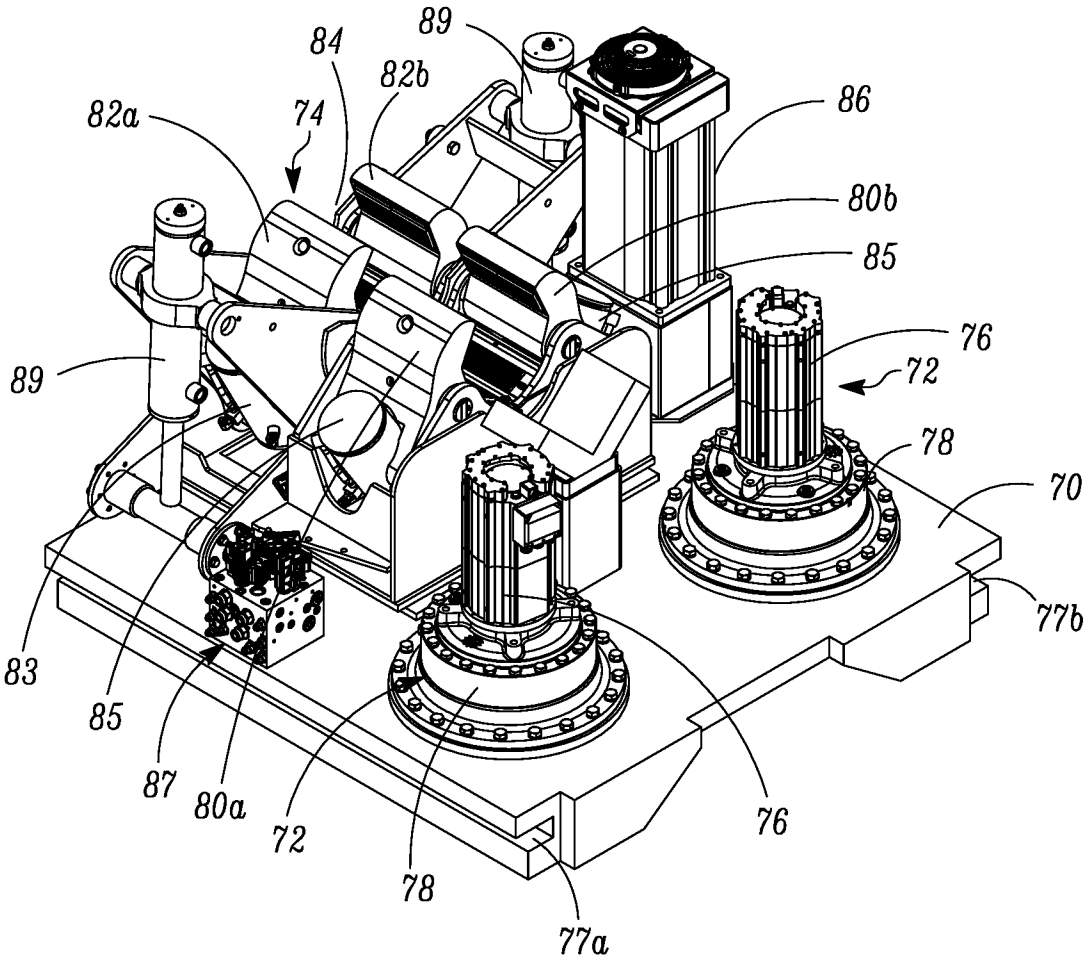
FIG. 13 is a perspective view of the vise carrier.

As best seen in FIG. 13, the platform 70 includes a pair of longitudinal side channels 77*a*, 77*b* that in use slidably receive opposing longitudinal rails 79*a*, 79*b* of the support frame 44. The channels 77*a*, 77*b* and rails 79*a*, 79*b* help guide the platform 70 when it moves along the support frame 44. Similar longitudinal side channels can be provided on the platform 50 of the traverse carrier 22 to help guide the platform 50 as the traverse carrier 22 moves forward and backward on the support frame 44.

Returning to FIGS. 5-8 and 13, the make/break vise mechanism 74 is configured to torque the joint between a new section of drill pipe and the drill string (i.e. make-up) and to initiate a break between a section of drill pipe to be removed and the drill string. The make/break mechanism 74 can be any mechanism that can achieve these functions. Referring to FIG. 13, in one embodiment, the make/break vise mechanism 74 includes opposing pairs of vise arms 80*a*, 80*b*, 82*a*, 82*b*. The vise arms 80*a-b*, 82*a-b* are actuatable between an open position shown in FIG. 13 and a closed position (not shown) where the vise arms 80*a-b* generally surround the drill string and the vise arms 82*a-b* (which can be referred to as the make/break vise) generally surround the drill pipe segment to be connected or detached. The vise arms 80*a-b*, 82*a-b* can be actuated by respective actuators 83, 85 which can be electric, hydraulic or pneumatic actuators. As shown in FIG. 13, in the open position, the opposing arms 80*a-b*, 82*a-b* define a channel 84 that is open vertically upward. This permits the drill pipe to be inserted into or removed from the top of the make/break vise mechanism 74 through the channel 84. The arms 82*a-b* are rotatable clockwise or counterclockwise relative to the arms 80*a-b* during pipe make-up and break-out. Rotation of the arms 82*a-b* clockwise or counterclockwise is achieved using actuators 89 which can be electric, hydraulic or pneumatic actuators. An example of the make/break vise mechanism 74 that could be used is the make/break vise mechanism used on the TONGHAND® exit side wrench available from LaValley Industries of Bemidji, Minn. On many conventional HDD rigs, the make/break vise mechanism is a closed ring requiring the drill pipe to be inserted longitudinally through one end of the closed ring.

In the case where the actuators 83, 85, 89 are hydraulic actuators, a suitable pump 86 is provided on the platform 70. The pump 86 pumps hydraulic fluid to and from the actuators 83, 85, 87, via a control manifold 87, to control operation of the actuators 83, 85, 87 to open and close the vise arms 80*a-b*, 82*a-b* and to rotate the make/break vise 82*a-b*. The pump 86 can be any pump that can supply pressurized fluid in the case of hydraulic or pneumatic actuators 83, 85, 89. In one embodiment, the pump 86 can be an e-pump (or electric motor driven pump) an example of which is the Hydrapulse™ electric motor driven pump available from Terzo Power Systems of El Dorado Hills, Calif. In other embodiments, instead of the pump 86, an electric motor and gearbox like the components 52, 60, 72 can be used that drive a pump to pressurize the fluid for the actuators.

The chiller system 24 is mounted on the platform 50 to the rear of the drive motors 54 and the rotation motors 62. As discussed above, the chiller system 24 is part of a cooling fluid circuit 90 that circulates and cools a refrigerant liquid that is circulated through various ones of the electric motors 54, 62, 76 on the HDD rig 12 for cooling the electric motors. Referring to FIG. 1, a schematic of the cooling fluid circuit 90 is illustrated. The circuit 90 includes a fluid manifold 92 that is fluidly connected to fluid inlets and outlets on the motors 54, 62, 76 to be cooled. A compressor is part of the circuit 90 and pressurizes the refrigerant and circulates the refrigerant through the motors 54, 62, 76 and through a condenser or heat exchanger (such as a fan moving air past heat exchange fins) where the refrigerant is cooled and recirculated by the condenser back to the motors 54, 62, 76 for cooling. The schematic cooling fluid circuit 90 shown in FIG. 1 shows only a single one of the vise carrier drive motors 76, however both of the motors 76 would be in the cooling fluid circuit 90 if both of the motors 76 are to be cooled. In addition, the motor for the pit pump 30 is optionally part of the circuit 90.

The chiller system 24 is not required to be on the platform 50 or on the traverse carrier 22. Instead, the chiller system 24 can be mounted elsewhere on the HDD rig 12 and even mounted off of the HDD rig 12.

A separate cooling circuit 94 is also provided for the oil that is used to lubricate and cool the gearboxes 56, 64, 78. The gearbox oil is circulated through the circuit 94 by a pump (not shown) and through an air cooled heat exchanger. In other embodiment, the chiller system 24 can be used to cool the gearboxes instead of the separate cooling circuit 94.

Figure 11:
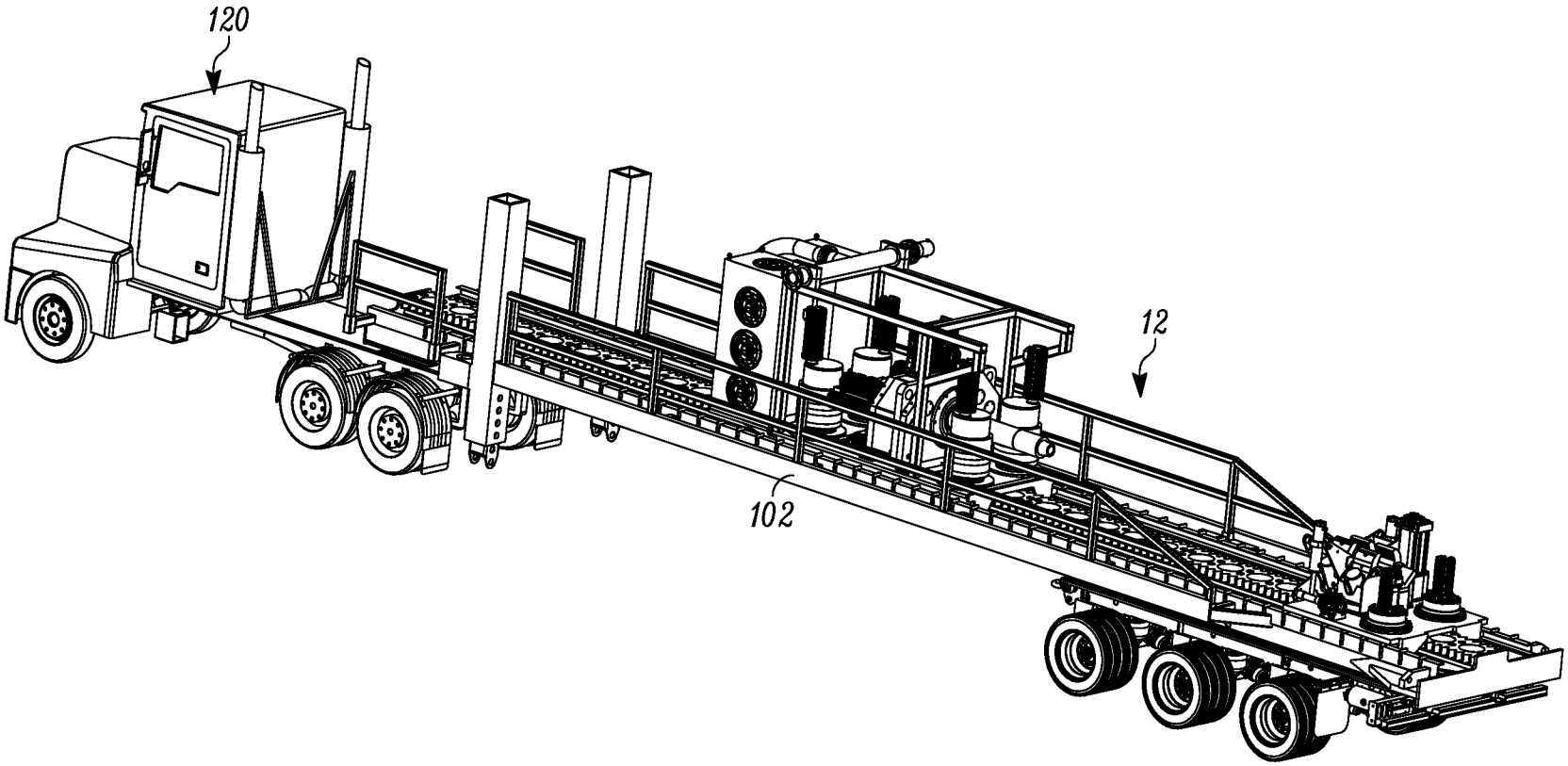
FIG. 11 is a perspective view illustrating the HDD rig connected to a tractor for transport.

Returning to FIGS. 5-8, the lift legs 28 are adjustable in length to raise and lower the end 44 of the support frame 40 thereby changing the angle of the HDD rig 12. The HDD rig 12 is illustrated as including two of the lift legs 28, one on each side of the support frame 40. However, a smaller or larger number of lift legs 28 can be used. The lift legs 28 can have any configuration that is suitable for raising and lowering the support frame 44 to adjust the HDD rig angle. In one embodiment, the lift legs 28 are each pivotally attached to side rails 100, 102 of the support frame 40 for pivoting movement between a stored position (shown in FIG. 11) where the lift legs 28 are pivoted inward and somewhat flush with the side rails 100, 102 and a deployed position (shown in FIGS. 5-8) where the lift legs 28 are pivoted outward away from the side rails 100, 102. Each lift leg 28 includes a receiver portion 104 and a telescoping extendable portion 106 that is telescoped within the receiver portion 104. An actuator (not shown), which can be electric, hydraulic or pneumatic, is connected between the receiver portion 104 and the extendable portion 106 to actuate the extendable portion 106 relative to the receiver portion 104. By extending the extendable portion 106 from the receiver portion 104, the HDD rig 12 is raised higher and the angle of the HDD rig 12 can be increased. Conversely, by retracting the extendable portion 106 into the receiver portion 104, the HDD rig 12 is lowered and the angle of the HDD rig 12 can be decreased. Optionally, locking holes 108 can be provided in the receiver portion and corresponding locking holes 110 can be provided in the extendable portion 106. When a desired angle of the HDD rig 12 is achieved, safety pins (not shown) can be inserted through aligned ones of the locking holes 108, 110 in the lift legs 28 as a safety measure to retain the positions of the extendable portions 106.

Figure 5:
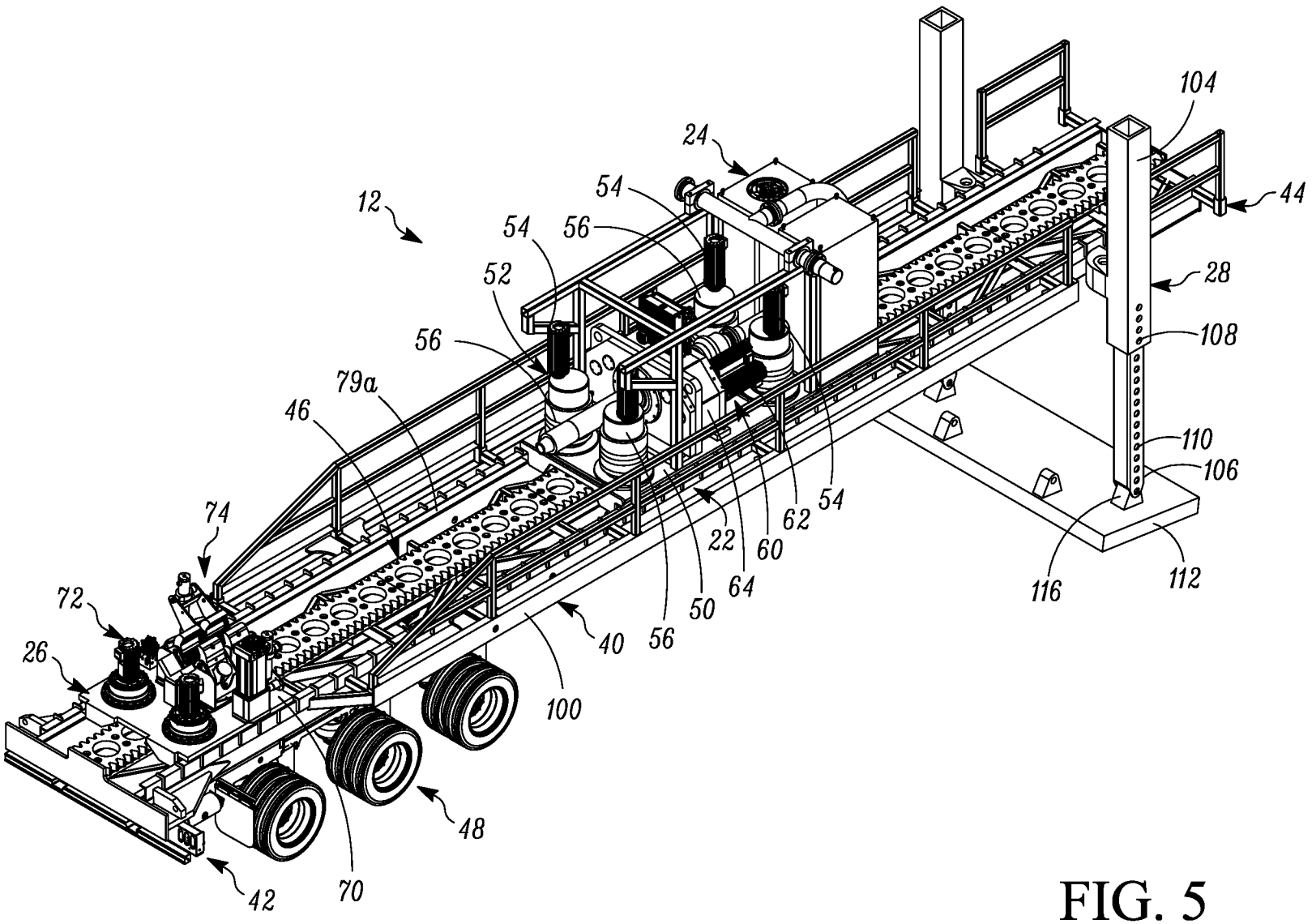
FIG. 5 is a perspective view of the HDD rig with the lift legs extended and the traverse carrier in a retracted position.
Figure 6:
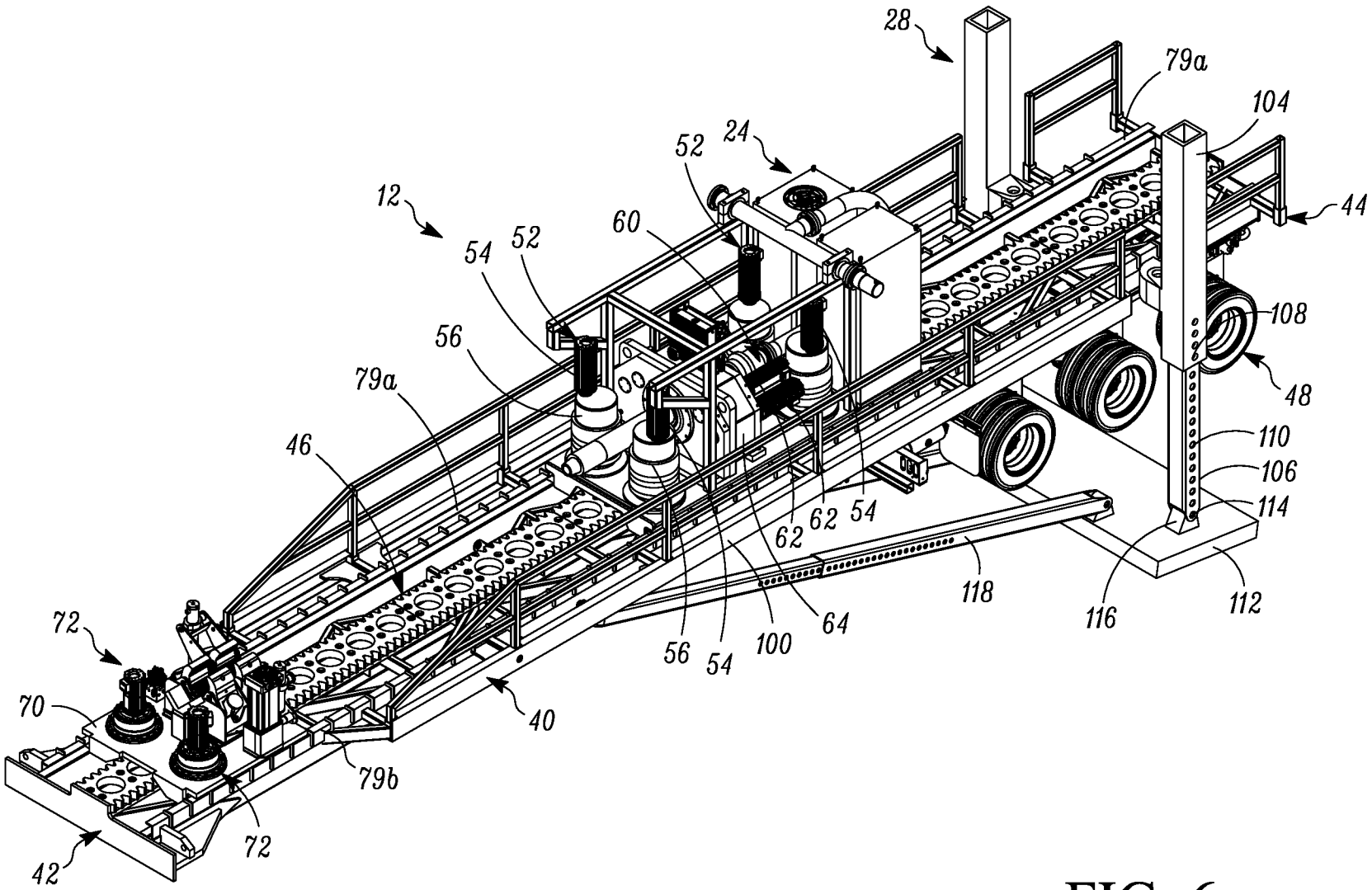
FIG. 6 is a perspective view of the HDD rig with the lift legs extended, the traverse carrier in a retracted position, and the wheel assembly retracted.
Figure 7:
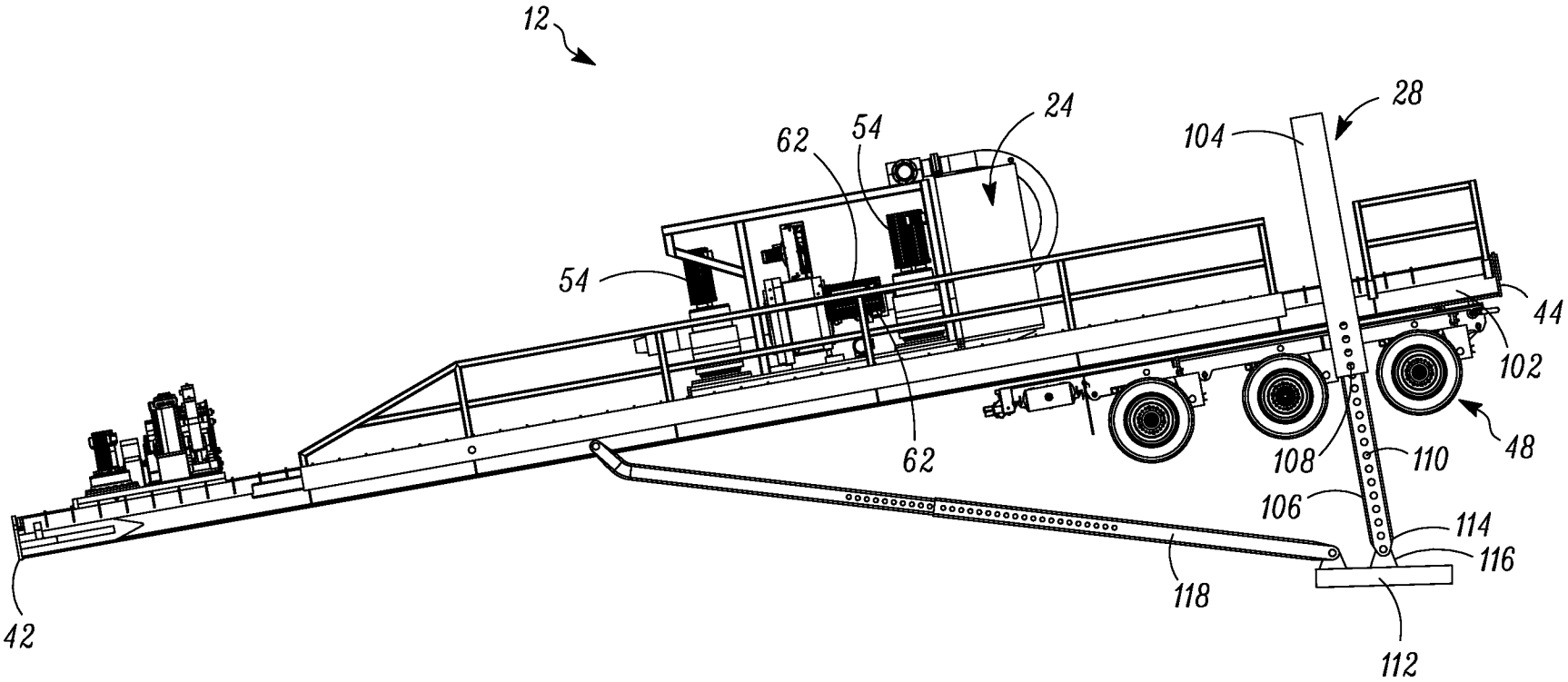
FIG. 7 is a side view of the HDD rig of FIG. 6.
Figure 8:
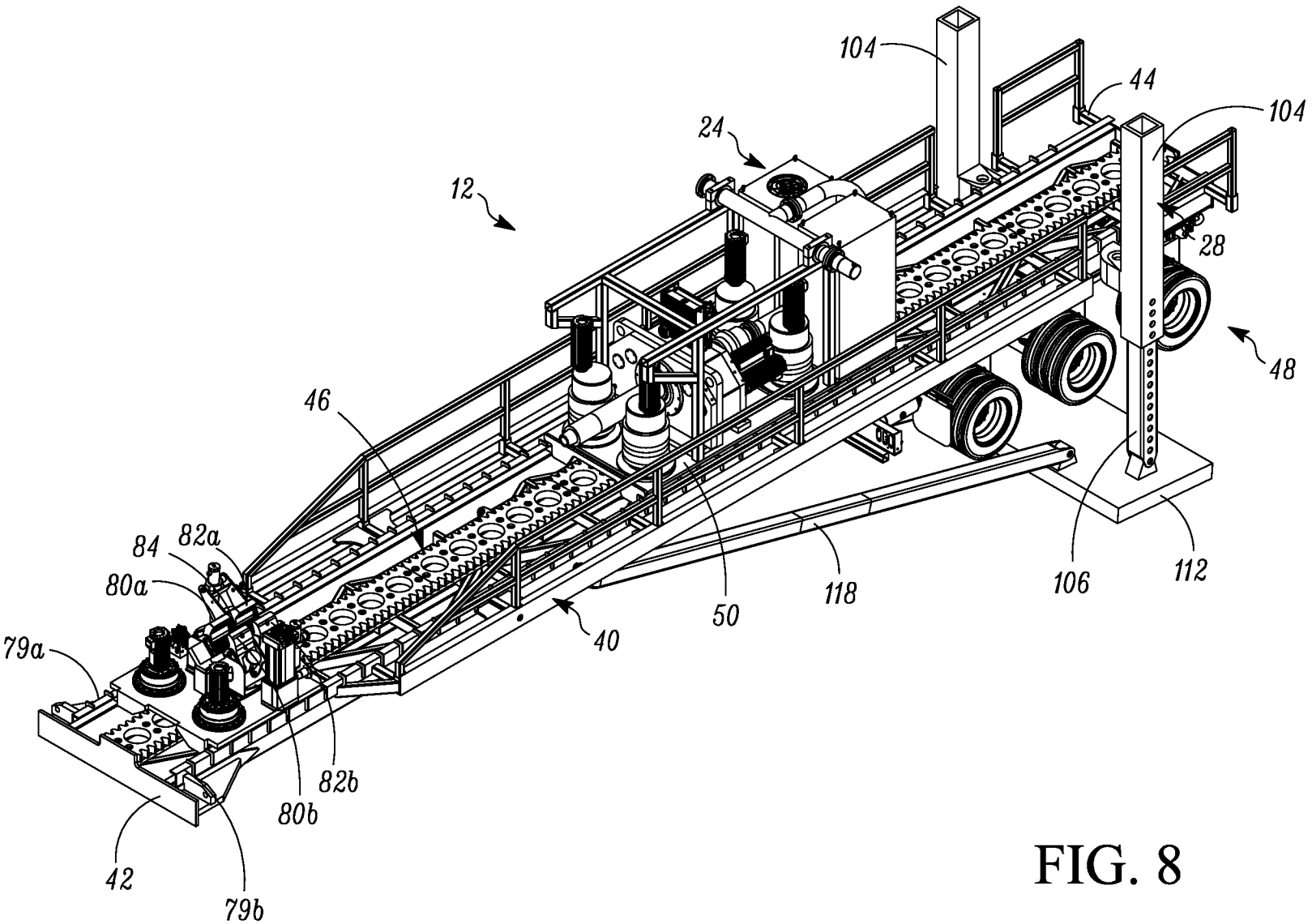
FIG. 8 is a perspective view of the HDD rig with the lift legs extended, the traverse carrier in a retracted position, and the wheel assembly retracted.

FIGS. 5-8 also illustrate that an optional support platform 112 can be arranged underneath the HDD rig 12 and upon which the ends of the lift legs 28 can be supported during use. A base end 114 of each one of the extendable portions 106 can be pivotally attached to a corresponding support flange 116 on the platform 112. This permits the lift legs 28 to pivot relative to the platform 112 when the HDD rig 12 is raised, as best seen in FIG. 7. Optionally, a pair of brace arms 118 can extend between and be connected to the base of the support frame 44 and the platform 112 to help support the HDD rig 12 when it is raised upward.

With continued reference to FIGS. 5-8, the wheel assembly 48 is movable in position on the support frame 40. For example, FIG. 5 shows the wheel assembly 48 at a transport position on the support frame 40 adjacent to the end 42 which is a position the wheel assembly 48 would be in during transport of the HDD rig 12 for example when being pulled by a tractor 120 (seen in FIG. 11). As shown in FIGS. 6 and 7, the wheel assembly 48 is movable on the support frame 40 toward the end 44. This position ensures that the wheel assembly 48 is off of the ground when the HDD rig 12 is raised to an operational or drilling position, and the end 42 is disposed on the ground for drilling. In some embodiments, the wheel assembly 48 can be moved to the position between the lifting legs 28 and the end 42. In other embodiments, the wheel assembly 48 can be moved from a first position (see FIG. 5) on one side of the lifting legs 28 to a second position (FIGS. 6-8) where at least a portion of the wheel assembly 48 is disposed on an opposite side of the lift legs 28. Such an extent of movement of the wheel assembly 48 is permitted by the fact that the lift legs 28 are mounted to the side rails 100, 102 so that the lift legs 28 do not interfere with movement of the wheel assembly 48.

Figure 10:
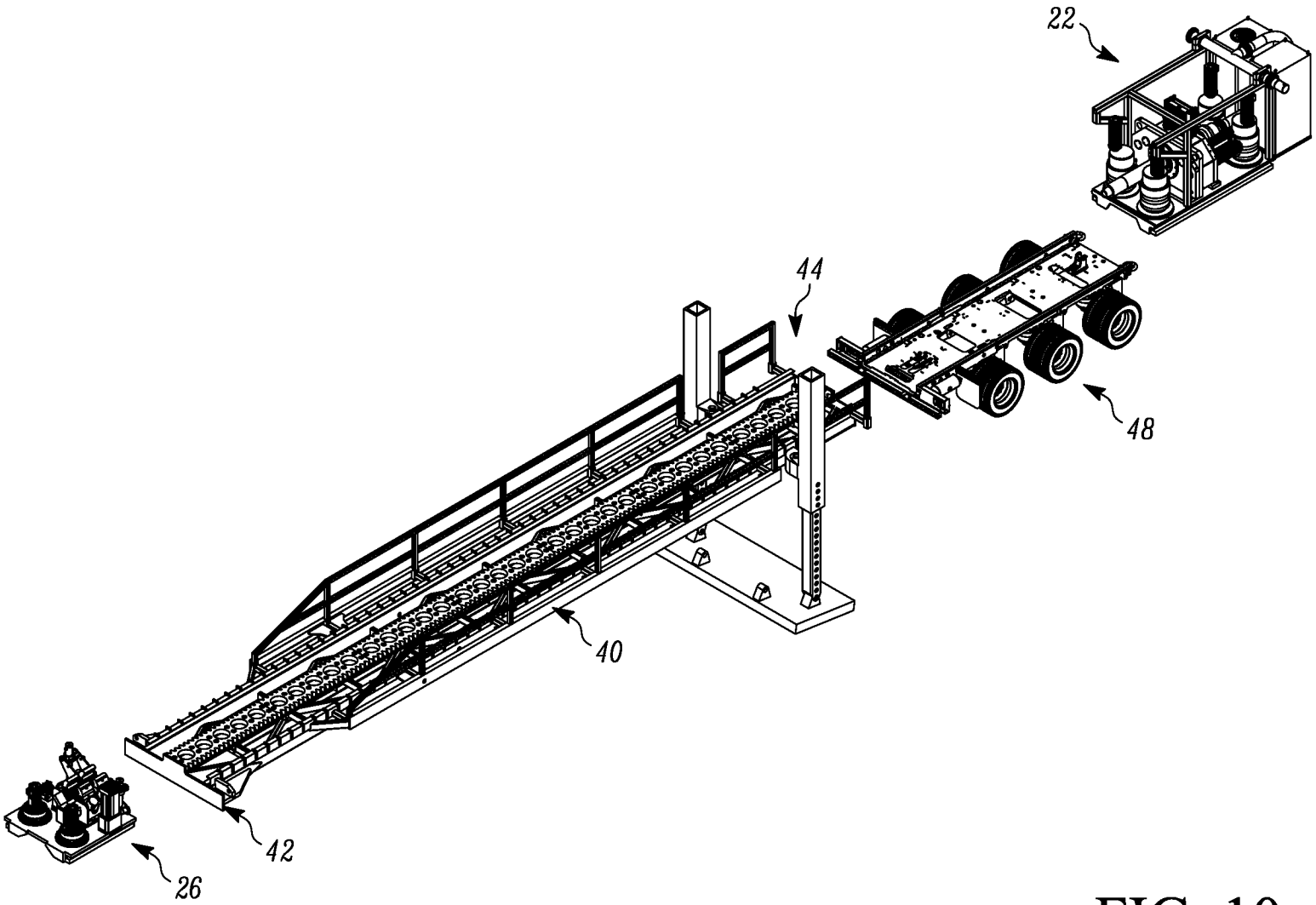
FIG. 10 is an exploded view of the HDD rig showing how the traverse carrier, the vise carrier and the wheel assembly can be removed from the ends of the support frame.

In some embodiments, the traverse carrier 22, the vise carrier 26 and/or the wheel assembly 48 may also be removable from or loadable onto the support frame 40 of the HDD rig 12 via either one of the ends 42, 44. For example, referring to FIG. 10, the traverse carrier 22 can be driven off or loaded from the end 44 of the support frame 40 as shown (or driven off or loaded from the opposite end 42; not shown). In one embodiment, the wheel assembly 48 can also be driven off or loaded from the end 44 of the support frame 40 as shown (or driven off or loaded from the opposite end 42; not shown). In one embodiment, the vise carrier 26 can also be driven off or loaded from the end 42 of the support frame as shown (or driven off or loaded from the opposite end 44; not shown).

Figure 12:
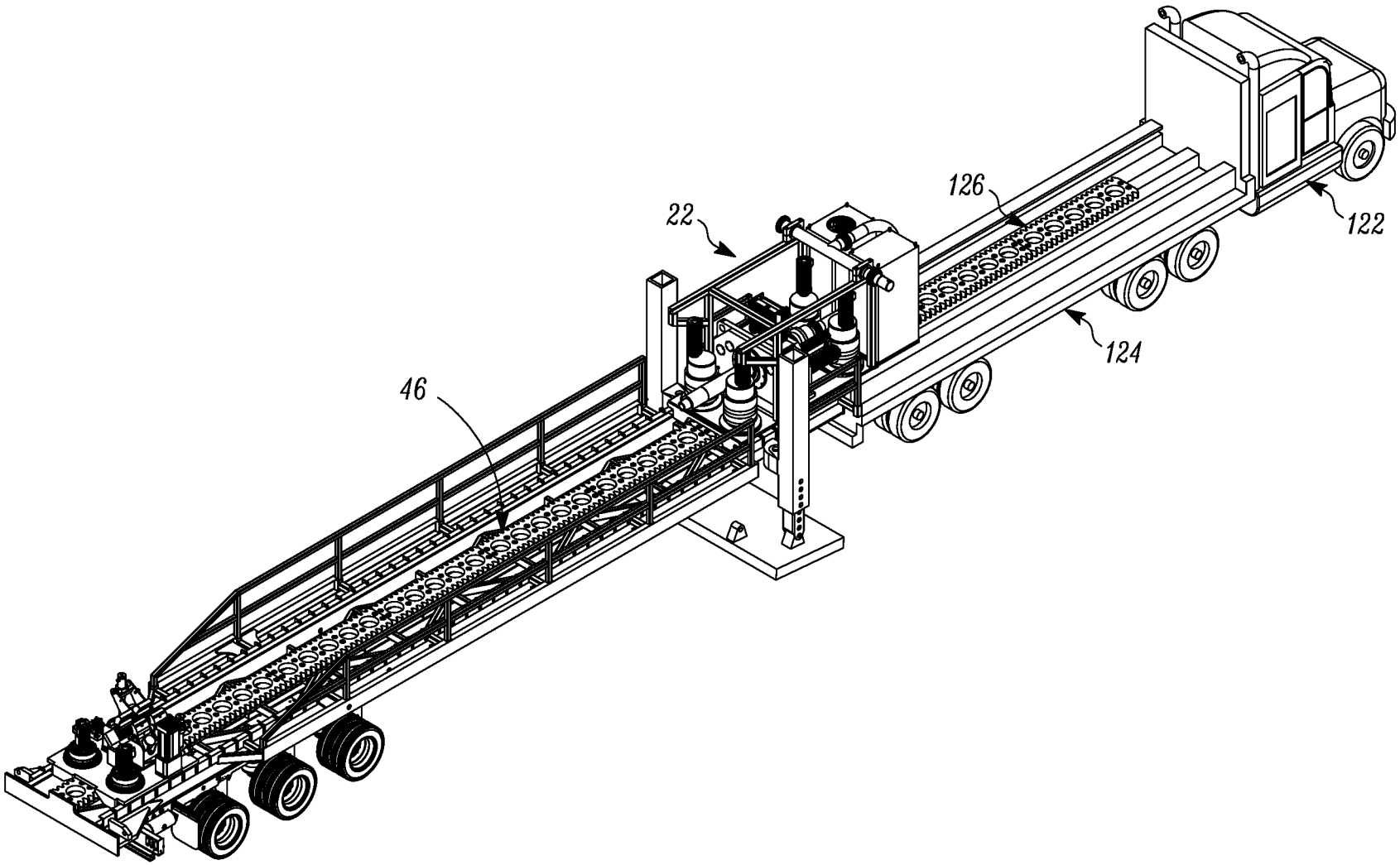
FIG. 12 is a perspective view illustrating the HDD rig positioned relative to a tractor and trailer that can transport the traverse carrier and vise carrier to and from the HDD rig.

Being able to actuate the traverse carrier 22 and/or the vise carrier 26 onto and off of the support frame 40 is beneficial because it allows the HDD rig 12 to be transported to a drill site without the added weight of the traverse carrier 22 and/or the vise carrier 26. The traverse carrier 22 and/or the vise carrier 26 can be separately transported to the drill site and then loaded onto the support frame 40 of the HDD rig 12, and then removed from the support frame at the end of the drilling job. For example, FIG. 12 illustrates the support frame 40 of the HDD rig 12 with the vise carrier 26 mounted thereon. A tractor 122 with a trailer 124 is backed up to the support frame 40. The trailer 124 includes a toothed rack 126 that is similar to the toothed rack 46. The traverse carrier 22 is movably disposed on the toothed rack 126 in a similar manner as on the toothed rack 46. The trailer 124 can be backed up to the support frame 40 to align the toothed rack 126 with the toothed rack 46. The traverse carrier 22 can then be driven from the trailer 124 onto the support frame 40, or driven from the support frame 40 and onto the trailer 124. Similarly, the vise carrier 26 can be driven from the trailer 124 onto the support frame 40, or driven from the support frame 40 and onto the trailer 124.

Figure 14:
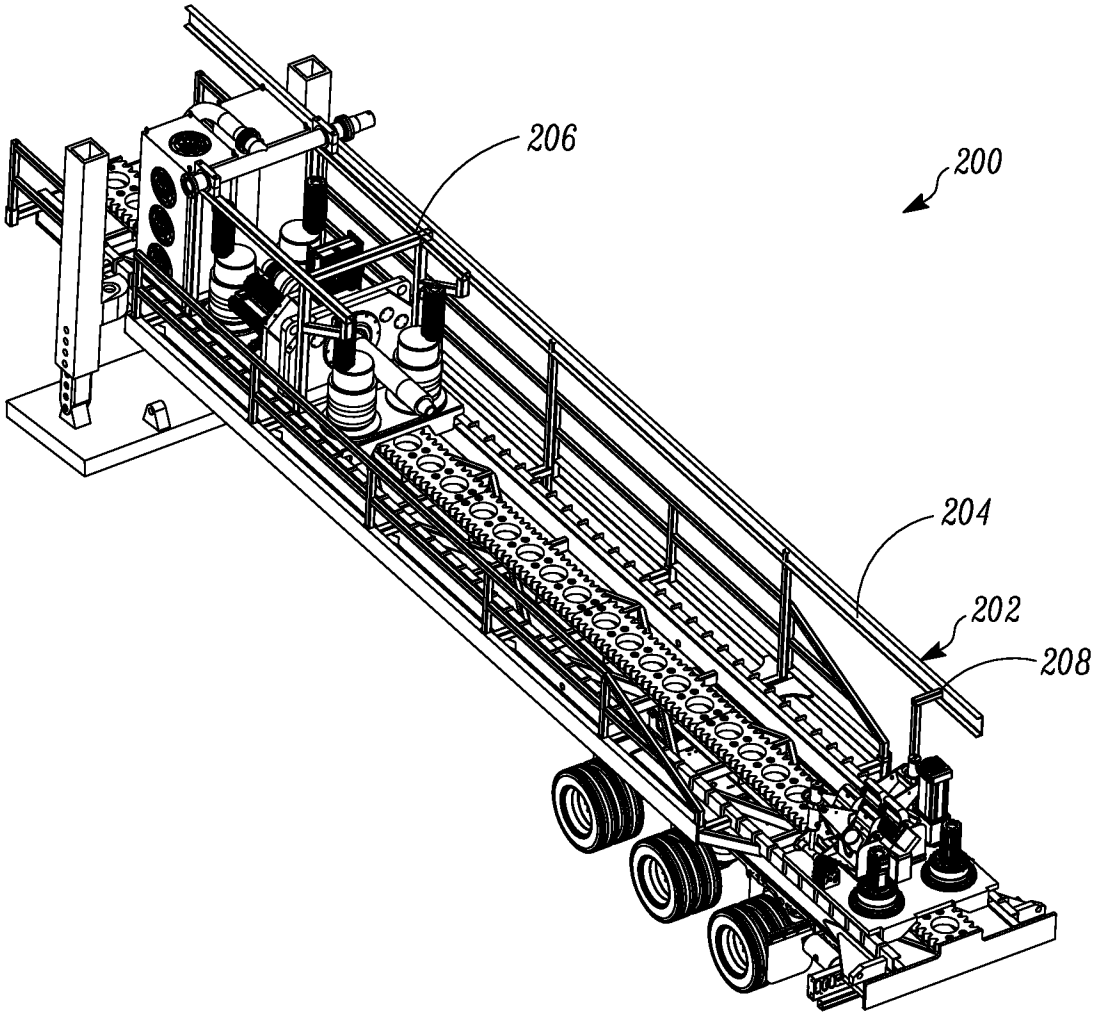
FIG. 14 is a perspective view of an embodiment of an HDD rig with an electrical buss bar.

FIG. 14 illustrates an embodiment of an HDD rig 200 that includes an electrical bus bar 202 that directs electrical power to the traverse carrier 22 and the vise carrier 26. The buss bar 202 includes a channel 204 that interfaces with electrical contacts, such as brushes, on arms 206, 208 that travel with the traverse carrier 22 and the vise carrier 26. Electrical power is directed from the arms 206, 208 to the various electrical components on the traverse carrier 22 and the vise carrier 26.

Referring to FIGS. 1 and 2, in some embodiments the control cab 14 can include a plurality of adjustable speed drives 130, such as variable frequency drives (VFDs). Each one of the VFDs 130 is electrically connected to and supply electrical power to one of the electric motors 54, 62, 76 on the HDD rig 12. One of the VFDs 130 can also be electrically connected to and supply electrical power to other electric motors of the HDD rig system 10 including the motor driving the pit pump 30, the condenser of the chiller system 24, and any other motors. The VFDs 130 condition the incoming AC voltage signal from the electric power source 16 to an AC voltage signal that is suitable for driving the electric motors. The VFDs 130 permit adjustment and control of the speed and torque of the electric motors by varying the input frequency and voltage of the AC voltage signal. An example of a VFD 130 that could be used is the AC890PX variable frequency drive available from Parker Hannifin Corporation of Cleveland, Ohio. However, other forms of adjustable speed drives could be used.

FIG. 2 illustrates the VFDs 130 as being located in a section of the control cab 14 that is separate from an operator section 132 that contains various controls on a control panel 134. However, the VFDs 130 could be located in the same section as the control panel 134. In addition, the VFDs 130 could be located elsewhere in the HDD rig system 10, such as in a building separate from the control cab 14. In addition, the control panel 134 can be located elsewhere including remote from the drilling site. For example, as shown in FIG. 2, a control panel 134' can be located remote from the drilling site with the control panel 134' being able to monitor the operation of various components of the system 10 and/or being able to control the operation of the system 10 as described further below.

Figure 4:
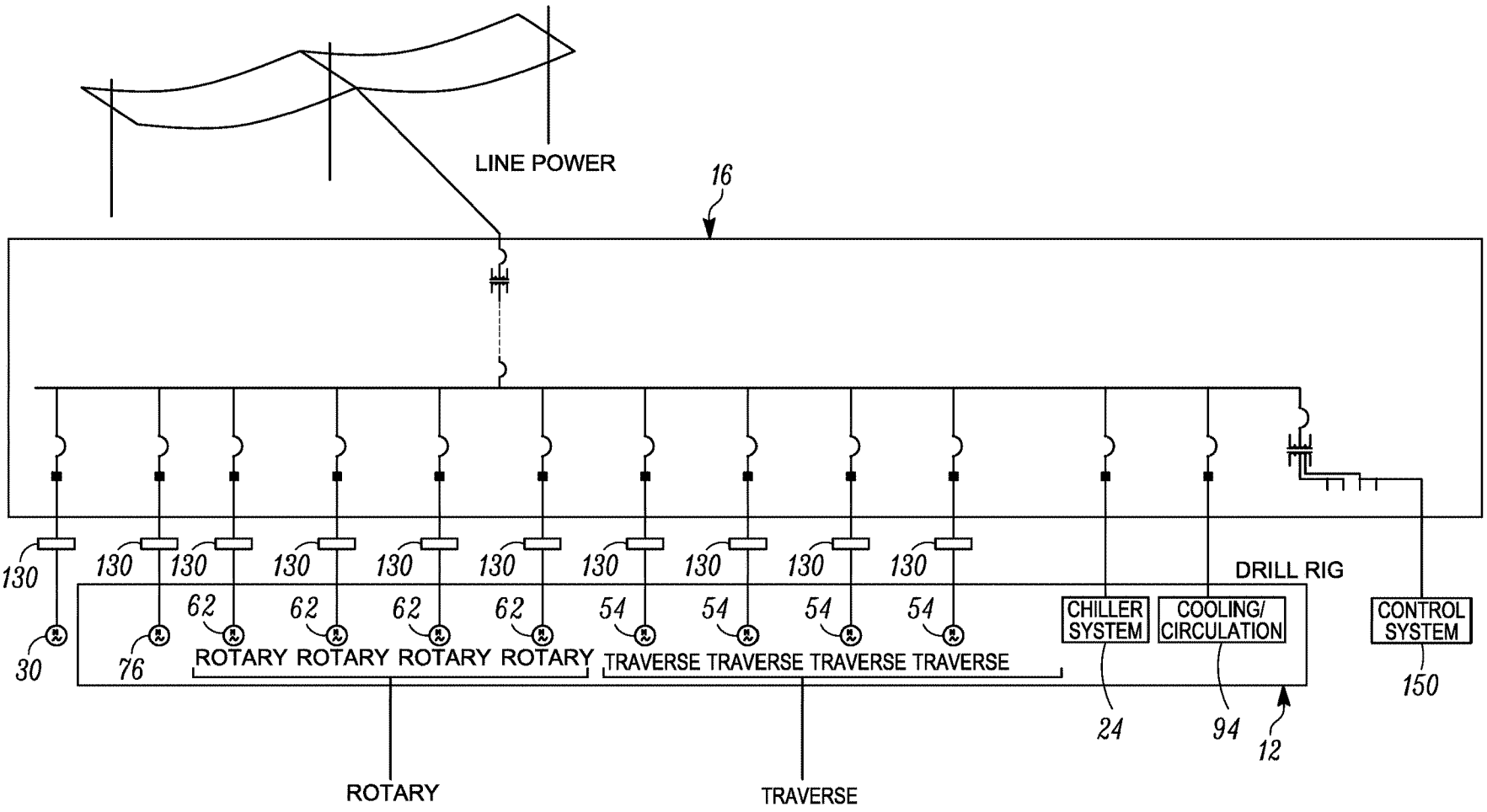
FIG. 4 depicts an electrical schematic where an electrical power source in the form of line power provides electrical power to the HDD rig system.

As described above, the electric power source 16 can be any source(s) of electric power. FIG. 3 illustrates an electrical schematic where the electric power source 16 is one or more electric generators. The adjustable speed drives 130 are illustrated as providing electrical power to various electrical components of the HDD rig system 10 including the motors 54, 62, 76, the motor for the pit pump 30, and the chiller system 24 (such as the condenser and a fan for the heat exchanger) and cooling circuit 94 (such as the oil pump and a fan for the heat exchanger). In addition, electrical power is provided to a control system 150 discussed further below. FIG. 4 illustrates an electrical schematic of an embodiment where the electric power source 16 is obtained from one or more power lines.

The performance of various individual components of the HDD rig system 10 can also be electronically monitored for example from the control panel 134 of the control cab 14. This monitoring permits specific identification of individual components that may be operating at a substandard or below expected performance level which could indicate an actual or imminent failure of the component or indicate that the specific component needs to be replaced. As described further below, in some embodiments, if a specific component is identified as operating at a substandard or below expected performance level, the performance of other similar components can be automatically or manually adjusted (upward or downward) from the control cab 14 to account for the substandard performance of the identified component. The monitoring of performance described herein may also be referred to as health monitoring of the individual components.

The performance of any of the components of the HDD rig system 10 can be monitored. In one embodiment, and referring to FIG. 9, the performance of the traverse carrier drive components 52, the drill pipe rotation components 60, the vise carrier 26 drive components 76, 78, 86, and the chiller system 24 can be monitored. In addition, the performance of other components of the HDD rig system 10, such as the performance of the pit pump 30, the performance of the adjustable speed drives 130, the performance of the cylinders 83, 85, 89 on the vise carrier 26, and other components can be monitored.

Figure 9:
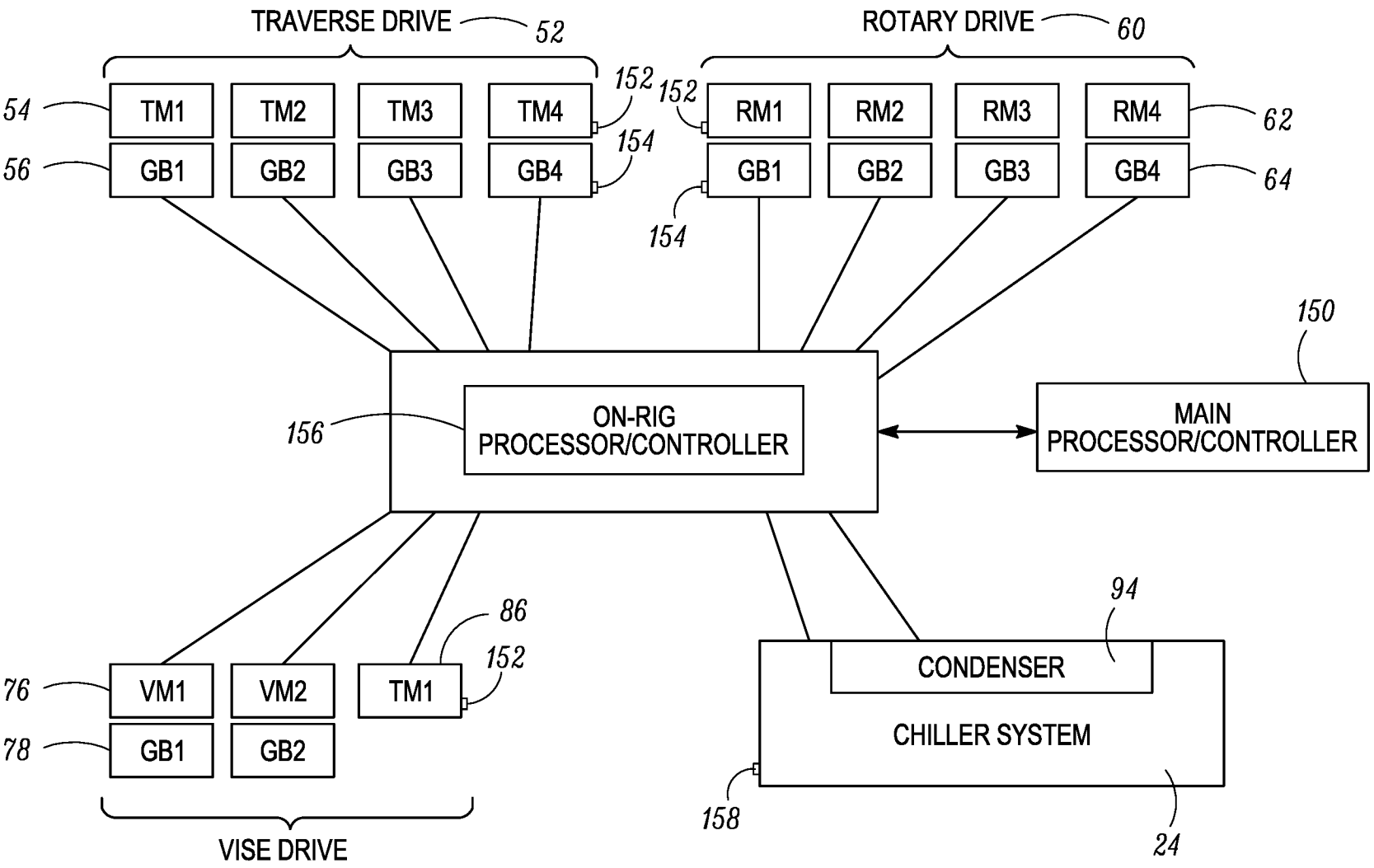
FIG. 9 is a schematic depiction of a health monitoring system that monitors the health of various components of the HDD rig system.

In the example illustrated in FIG. 9, the four traverse carrier drive components 52 and the four drill pipe rotation components 60 are illustrated, with the electric motors 54, 62 indicated as TM1-4 (traverse motors 1-4) or as RM1-4 (rotation motors 1-4), and the gearboxes 56, 64 indicated as GB1-4 (gearboxes 1-4). Similarly, the vise carrier 26 drive components 76, 78, 86 are indicated as VM1-2 (vise carrier traverse motors 1-2), TM1 (vise carrier pump and motor), and the gearboxes indicated as GB1-2 (gearboxes 1-2).

Each of the motors 54, 62, 76, 86 has one or more associated sensors 152 (only some of the sensors 152 are illustrated in FIG. 9) that sense various operational parameters of the motors. For example, the sensors 152 can sense parameters such as, but not limited to, rotation speed, output torque, motor temperature, temperature of the coolant entering and/or exiting the motors, and other parameters of the motors. Likewise, each of the gearboxes 56, 64, 78 has one or more associated sensors 154 (only some of the sensors 154 are illustrated in FIG. 9) that sense various operational parameters of the gearboxes. For example, the sensors 154 can sense parameters such as, but not limited to, output rotation speed, output torque, various shaft speeds of the gearbox, gearbox temperature, temperature of the gearbox bearings, and other parameters of the gearboxes. The readings from the sensors 152, 154 can be output to an on-rig processor/controller 156 which can then direct the signals to the main off-rig control system 150. Alternatively, the on-rig processor/controller 156 is optional, and the sensor signals can be input directly to the control system 150.

Since each individual motor and gearbox is electronically monitored, the performance of each can be monitored. If one of the motors or gearboxes is operating below expectations or has failed, the system operator in the control cab 14 can be notified. In the case of the traverse carrier drive components 52 and the drill pipe rotation components 60, since there are four separate mechanisms for each, if one of the motors or gearboxes of the traverse carrier drive components 52 or of the drill pipe rotation components 60 is not performing as expected, the operation of one or more of the other three motors can be adjusted by their corresponding adjustable speed drives 130 accordingly to account for the misperforming component.

Similarly, with continued reference to FIG. 9, the performance of the chiller system 24 can be electronically monitored. For example, one or more sensors 158 (only some of the sensors 158 are illustrated in FIG. 9) can be provided that sense various operational parameters of the chiller system 24. For example, the sensors 158 can sense parameters such as but not limited to: the temperature of the refrigerant in the manifold 92; the temperature of the refrigerant entering and/or exiting the heat exchanger; the pressure of the refrigerant at various locations in the chiller system 24; the flow rate of the refrigerant at various locations in the chiller system 24; the ambient temperature surrounding the chiller system 24; the rotation speed, output torque, motor temperature of the motor driving the condenser; and other parameters of the chiller system 24. The readings from the sensor(s) 158 can be output to the on-rig processor/controller 156 which can then direct the signals to the main off-rig control system 150, or the signals can be input directly into the control system 150.

The performance of the adjustable speed drives 130 can also be electronically monitored. If one of the adjustable speed drives 130 is identified as performing improperly, the adjustable speed drive 130 can be replaced. Optionally, before replacement of an adjustable speed drive 130, operation of other ones of the adjustable speed drives 130 can be adjusted to adjust the performance of the corresponding component it is powering in order to account for the improperly performing adjustable speed 130 and its corresponding component it is powering.

The cycles of various components can also be monitored and tracked. At the end of a predetermine number of cycles, the component can be replaced after completing the number of cycles instead of replacing the component only after it fails or begins to fail.

In addition, the performance of the various components can be monitored remotely (i.e. away from the drilling site), for example at an office location of the entity that owns the rig system 10 or that is performing the drilling, by transmitting the signals to the remote location as indicated by element 164' in FIG. 2. In addition, this remote communication permits parameters of the drilling being performed by the rig system 10 to be set remotely, for example from an office location of the entity that owns the rig system 10 or that is performing the drilling.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A horizontal directional drilling rig system, comprising:

a horizontal directional drilling rig that includes a support frame, a traverse carrier movably disposed on the support frame for forward and reverse movement on the support frame, traverse carrier drive components disposed on the traverse carrier, and drill pipe rotation components disposed on the traverse carrier;

power control components that supply power to the traverse carrier drive components and the drill pipe rotation components; and a health monitoring system that electronically monitors the performance and/or life cycle of one or more of: the traverse carrier drive components, the drill pipe rotation components, and the power control components;

the health monitoring system can identify a specific one of the traverse carrier drive components, a specific one of the drill pipe rotation components, or a specific one of the power control components as having substandard performance and based on such identification:

i) adjust the performance of at least one of the other traverse carrier drive components if one of the traverse carrier drive components is identified as having substandard performance, or adjust the performance of at least one of the other drill pipe rotation components if one of the drill pipe rotation components is identified as having substandard performance, or adjust the performance of at least one of the other power control components if one of the power control components is identified as having substandard performance.

2. The horizontal directional drilling rig system of claim 1, wherein each one of the traverse carrier drive components comprises an electric drive motor and a gearbox engaged with the electric drive motor, and the health monitoring system monitors the performance and/or life cycles of the electric drive motors and the gearboxes.

3. The horizontal directional drilling rig system of claim 2, wherein the power control components comprise variable frequency drives electrically connected to the electric drive motors.

4. The horizontal directional drilling rig system of claim 2, wherein the power control components comprise a hydraulic pump.

5. The horizontal directional drilling rig system of claim 1, wherein each one of the drill pipe rotation components comprises an electric drive motor and a gearbox engaged with the electric drive motor, and the health monitoring system monitors the performance and/or life cycles of the electric drive motors and the gearboxes.

6. The horizontal directional drilling rig system of claim 1, further comprising a control cab separate from the horizontal directional drilling rig, and the power control components are disposed in the control cab.

7. The horizontal directional drilling rig system of claim 6, further comprising controls in the control cab that permit user control of the operation of the power control components.

8. The horizontal directional drilling rig system of claim 1, further comprising a chiller system disposed on the horizontal directional drilling rig, the chiller system defining a refrigerant system that cools drive motors of the traverse carrier drive components and drive motors of the drill pipe rotation components using a refrigerant.

9. The horizontal directional drilling rig system of claim 8, wherein the health monitoring system monitors the performance and/or life cycle of the chiller system.

10. The horizontal directional drilling rig system of claim 1, further comprising a vise carrier movably disposed on the support frame, and a make/break vise mechanism disposed on the vise carrier; and the health monitoring system monitors the performance and/or life cycle of the vise carrier.

11. The horizontal directional drilling rig system of claim 10, wherein the support frame includes first and second opposite ends, and the traverse carrier and the vise carrier are each removable from the first end or from the second end of the support frame.

12. The horizontal directional drilling rig system of claim 1, further comprising a wheel assembly connected to the support frame adjacent to one end thereof that support the support frame for rolling movement along the ground, and actuatable support frame lifting legs connected to the support frame that are actuatable to lift the support frame to a desired angle; and wherein the wheel assembly is movable in position on the support frame from a first position on one side of the actuatable support frame lifting arms to a second position where at least a portion of the wheel assembly is disposed on an opposite side of the actuatable support frame lifting legs.

13. A horizontal directional drilling rig operation method, the horizontal directional drilling rig includes traverse carrier drive components disposed on a traverse carrier and drill pipe rotation components disposed on the traverse carrier, the method comprising:

electronically monitoring the performance and/or life cycle of one or more of the following:

electric drive motors of the traverse carrier drive components;

electric drive motors of the drill pipe rotation components;

power control components that supply power to the traverse carrier drive components and the drill pipe rotation components;

identifying one of the traverse carrier drive components as having substandard performance and as a result of such identification adjusting the performance of another one of the traverse carrier drive components; or identifying one of the electric drive motors as having substandard performance and as a result of such identification adjusting the performance of another one of the electric drive motors; or identifying one of the power control components as having substandard performance and as a result of such identification adjusting the performance of another one of the power control components.

14. A horizontal directional drilling rig operation method, the horizontal directional drilling rig includes traverse carrier drive components disposed on a traverse carrier and drill pipe rotation components disposed on the traverse carrier, the method comprising:

electronically monitoring the performance and/or life cycle of one or more of the following:

the traverse carrier drive components;

the drill pipe rotation components;

power control components that supply power to the traverse carrier drive components and the drill pipe rotation components;

based on the electronic monitoring, identifying a specific one of the traverse carrier drive components, a specific one of the drill pipe rotation components, or a specific one of the power control components as having substandard performance and/or being at the end of its life cycle; and adjusting the performance of at least one of the other traverse carrier drive components when one of the traverse carrier drive components is identified as having substandard performance, or adjusting the performance of at least one of the other drill pipe rotation components when one of the drill pipe rotation components is identified as having substandard performance, or adjusting the performance of at least one of the other power control components when one of the power control components is identified as having substandard performance.

15. The method of claim 14, wherein each one of the traverse carrier drive components comprises an electric drive motor and a gearbox engaged with the electric drive motor, and comprising monitoring the performance and/or life cycles of the electric drive motors and the gearboxes.

16. The method of claim 15, wherein the power control components comprise variable frequency drives electrically connected to the electric drive motors.

17. The method of claim 14, wherein each one of the drill pipe rotation components comprises an electric drive motor and a gearbox engaged with the electric drive motor, and comprising monitoring the performance and/or life cycles of the electric drive motors and the gearboxes.

18. The method of claim 14, comprising electronically monitoring the performance and/or life cycles of each of the traverse carrier drive components, the drill pipe rotation components, and the power control components.

* * * * *